United States Patent [19]

Van Der Heijden et al.

[11] Patent Number: 4,945,283

[45] Date of Patent: Jul. 31, 1990

[54] CATHODE RAY TUBE HAVING A TUBULAR FOCUS STRUCTURE

[75] Inventors: Antonius W. F. Van Der Heijden; Gerardus J. Hellings; Erich E. Himmelbauer; Tjerk G. Spanjer; Gerardus A. H. M. Vrijssen, all of Eindhoven, Netherlands

[73] Assignee: U.S. Philips Corporation, New York, N.Y.

[21] Appl. No.: 301,001

[22] Filed: Jan. 23, 1989

[30] Foreign Application Priority Data

Jan. 27, 1988 [NL] Netherlands ..... 8800194

[51] Int. Cl.[5] ..... H01J 29/02; H01J 29/62

[52] U.S. Cl. ..... 313/450; 313/451; 313/456

[58] Field of Search ..... 313/450, 451, 456, 457

[56] References Cited

U.S. PATENT DOCUMENTS 3,375,390 3/1968 Schlesinger ..... 313/450
3,950,667 4/1976 DeJong et al. ..... 313/450
4,857,797 8/1989 Vrijssen et al. ..... 313/450

*Primary Examiner*—Kenneth Wieder
*Attorney, Agent, or Firm*—Robert J. Kraus

[57] ABSTRACT

Cathode ray tube having an electron gun positioned in the neck portion, the gun comprising a beam-forming part and a focusing structure and the beam-forming part comprising at least a cathode and a metal electrode plate provided with a central aperture, and the focusing structure comprising a hollow tube of an electrically insulating material with inner and outer surfaces and with a layer of high-ohmic resistive material on at least one of the surfaces. The electrodes of the beam-forming part of the electron gun are secured via metal pins to rods for forming an assembly. The hollow tube is directly secured to the metal electrode plate for the purpose of correct alignment. The tube has a first and a second end face, the first end face in one embodiment having a metal plate with a coaxial aperture, and the said metal plate is fixedly connected to the metal electrode plate of the beam-shaping part of the electron gun in such a way that their apertures are coaxial.

12 Claims, 5 Drawing Sheets

CATHODE RAY TUBE HAVING A TUBULAR FOCUS STRUCTURE

BACKGROUND OF THE INVENTION

The invention relates to a cathode ray tube having an envelope comprising a phosphor screen on one side and a neck portion on the other side, and an electron gun positioned in the neck portion and having a beam-forming part and a focusing structure, said beam-forming part comprising at least a cathode and a metal electrode plate provided with a central aperture, said focusing structure comprising a hollow tube of an electrically insulating material with inner and outer surfaces and with a layer of resistive material on at least one of the surfaces.

A cathode ray tube of this type is known from EP-A 233,379, corresponding to U.S. Pat. No. 4,857,797. The cathode ray tube described in this Specification has an electron gun comprising a hollow glass tube. During manufacture the glass tube is softened by heating it and is drawn on an accurately made mandril whose diameter changes several times in the longitudinal direction. Abutment faces for the electrodes of the beam-forming part of the gun are formed on the inner side of the tube thus calibrated. The focusing structure is formed by a resistive layer which is provided in a helical shape on the inner wall of the glass tube.

If such a "glass" gun is made in large quantities, the very accurately made (and hence costly) mandrils required during manufacture appear to be subject to rapid wear. This is at the expense of reproducibility. Moreover, it appears to be a problem to construct the electrode components to be inserted in the glass tube with a sufficiently constant shape.

SUMMARY OF THE INVENTION

It is an object of the invention to provide a cathode ray tube of the type described in the opening paragraph with an electron gun which can be manufactured in large quantities in a simple manner, with good reproducibility and at relatively low cost.

According to the invention the cathode ray tube of the type described in the opening paragraph is therefore characterized in that the components of the beam-forming part of the electron gun are secured through metal pins (or brackets) to insulating assembly rods, in that the tube has a first and a second apertured end face and in that the first end face is fixedly connected to the metal plate of the electrode of the beam-forming part of the electron gun, the apertures in said electrode plate and said end face facing each other for passing the electrons emitted by the cathode.

In the construction described above the components of the beam-forming part are secured to rods. The (glass) tube therefore does not require abutment faces for the electrodes of the beam-shaping part and may thus be "straight". Consequently, its manufacture does not require a (rapidly wearing) accurately made mandril to provide abutment faces. Due to the direct fixation of the hollow tube to the (last) electrode plate of the beam-forming part a correct alignment of the gun components can nevertheless be ensured, particularly if this fixation is established via an apertured metal plate provided on the end face.

Another complication in the manufacture of the electron gun of the known cathode ray tube is that a plurality of electrical connections through the wall of the tube must be made because the electrodes of the beam-forming part and the resistive layer of the focusing structure are provided on the inner side of one and the same hollow tube. In the construction according to the invention the electrodes of the beam-forming part are directly connected and the use of a metal plate arranged at the end of the hollow tube for the purpose of fixation provides the possibility of directly connecting the resistive layer to the inner surface.

An embodiment of the cathode ray tube according to the invention is therefore characterized in that a resistive layer is provided on the inner surface of the hollow tube and establishes electrical contact with the metal plate on the first end face of the tube. An electrical connection with the resistive layer can therefore be established through the metal plate so that it is not necessary to make a lead-through through the wall of the tube. Such a construction may also be used advantageously for the other end of the tube.

Another embodiment of the invention is therefore characterized in that the second end face of the tube is also provided with an apertured metal plate and in that said plate also establishes electrical contact with the resistive layer on the inner surface.

Preferably, springs for centring the tube in the neck portion of the cathode ray tube are secured to the metal plate on the second end face. These springs may also be used for electrically connecting the metal plate (and hence the resistive layer) to an electrically conducting layer on the inner wall of the cathode ray tube connected to the anode high-voltage contact.

For connecting the metal plates to the ends of the tube of the focusing structure, which may be made of, for example, glass or a ceramic material, it is possible to use different techniques, such as

- thermal fusion of the (glass) tube to the metal;
- thermal connection through a soldering enamel;
- local fusion by means of high-frequency heating;
- providing each metal plate with a bush which is clamped in the hollow tube.

The tube with its metal plate on the first end face is subsequently fixedly connected to the metal plate of the last electrode of the beam-forming part of the gun. When making this connection, a centring mechanism may advantageously be used, as will be described hereinafter. The connection itself is preferably established by means of welding. An alternative method is connecting with, for example, a soldering enamel or a glass-ceramic material, but it is then less practical to make the electrical connection. The last-mentioned connection technique is, however, required if the end of the hollow tube is directly secured to the metal electrode plate.

The electron gun is the cathode ray tube according to the invention has a versatile construction, that is to say, its use is not limited to a monochrome cathode ray tube with an electron gun having a single beam-forming part and a single focusing structure. The construction may be used to equal advantage in applications in which the beam-forming part is to produce three electron beams in which either the three beams may have the focusng structure in common or in which each beam has its own focusing structure. In the latter case each of the three focusing structures may either comprise a tube of an electrically insulating material or the three focusing structures may be accommodated in a tube having three internal ducts.

BRIEF DESCRIPTION OF THE DRAWING

The invention will now be described in greater detail, by way of example, with reference to the accompanying drawing figures in which

Referring to FIG. 1, the constructive concept of the invention will be described in a general sense. FIG. 1 shows a cathode ray tube 1 having an electron gun 23 arranged in a neck portion 2. A G1 (grid) electrode structure 22 has a typical aperture behind which a cathode 24 with an electron-emissive surface is arranged, with a filament 25 adjoining it. A G2 electrode structure, in this case in the form of a metal plate 26 having a central aperture, is arranged further to the front and adjoins the G1 electrode structure 22. Arranged still further to the front is a G3 electrode structure in the form of a metal plate 27. For forming an assembly the electrode structures 22, 26 and 27 constituting the beam-forming part—in this case the (triode) part—of the gun are secured through pins (or brackets) to insulating assembly rods 48, 50, 52, 54 (see FIG. 2). Thus, four rods are used in this case. The invention is, however, not limited thereto. For example, two or three rods may be used in an alternative and conventional way. A focusing structure 28 comprises a hollow cylinder 32 which may be made of glass or a ceramic material and in this case its inner surface is coated with a layer of resistive material 34. In the relevant case the layer 34 has the shape of a helix. The cylinder 32 is provided at one end with a metal plate of flange 29 with which it is fixedly connected to the metal plate 27 of the electrode structure. The cylinder 32 is provided at its other end with a metal plate 31 to which four springs 36 (FIG. 2) are secured which centre the gun 23 in the neck 20 and connect the resistive layer 34 through the metal plate 31 to a neck coating 33 of electrically conducting material which establishes an electrical contact with a high-voltage contact (not shown).

A gun assembly step is described in greater detail with reference to FIG. 3. There are various possibilities of coupling the focusing structure to the beam-forming (triode) part of the gun.

Figure 3:
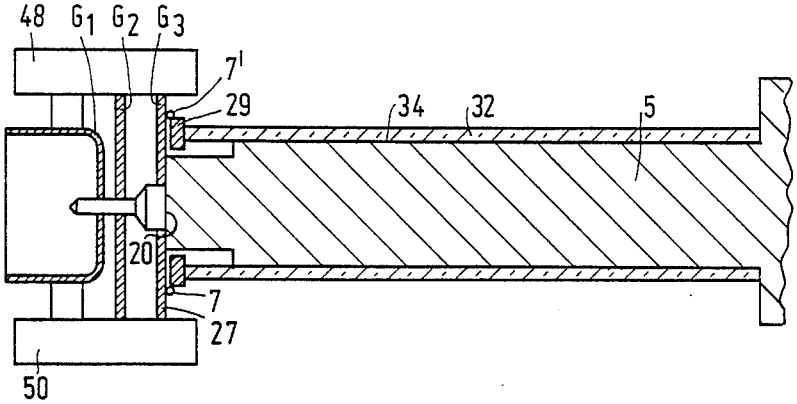
FIG. 3 is a diagrammatic cross-section through the electron gun of the cathode ray tube of FIG. 1, illustrating the method of assembly.

FIG. 3 shows diagrammatically the beam-forming part (triode) of an electron gun with four rods, of which the rods 48 and 50 are visible in the Figure, to which three electrodes $G_1$, $G_2$ and $G_3$ are secured. Electrode $G_3$ (the last electrode of the triode part) has the shape of a metal plate 27 provided with a central aperture 20. A hollow cylinder 32 which may be made of, for example, glass is secured to this plate 27 in the following manner. The hollow cylinder 32 is provided at one end with a flat metal ring 29. The inner diameter of this ring is preferably so large that it does not have a beam-limiting effect. The hollow cylinder 32 is welded by means of a centring mechanism 5 through the ring 29 to the metal plate 27. The welding spots are denoted diagrammatically by the reference numerals 7, 7', . . . Welding may be carried out by means of, for example, a laser welding process or another welding process exerting minimum possible forces on the components. If a possible small obliqueness is to be corrected, a gap-bridging welding process is recommendable, for example, MIG welding.

The centring mechanism 5 comprises a mandril accurately fitting in the hollow cylinder 32 and narrowing stepwise towards the end so as to accurately fit in the apertures of the $G_1$, $G_2$ and $G_3$ electrodes. The method of mounting shown in FIG. 3 is simple, quick, easy to automate and is suitable for mounting both one hollow cylinder and a number of hollow cylinders (for example, three) on a triode component. When securing the metal ring 29 to the hollow cylinder 32, the ring can be positioned accurately in such a way that it can subsequently be used for centring the cylinder with respect to the beam-forming part. An alternative is to give the ring a coarse positioning and to use the inner wall of the cylinder itself for centring the cylinder with respect to the beam-forming part.

Materials having coefficients of expansion which are adapted to each other are preferably used for the hollow cylinder 32 and the metal ring 29. A suitable choice is, for example, G28 glass for the hollow cylinder in combination with molybdenum or an iron-nickle-cobalt alloy for the ring, or lead glass or lime glass for the hollow cylinder in combination with FeCr for the ring.

For connecting the (glass) hollow cylinder to the metal ring it is possible to use different techniques such as, for example:

thermal fusion,
thermal connection through soldering enamels,
high-frequency fusion (local).

When using these techniques it is possible to prevent softening or deformation of the (glass) hollow cylinders to a considerable extent. This is important with a view to obtaining a focusing structure with a maximum possible freedom from aberrations. For realizing a focusing structure a layer of high-ohmic resistive material 34 is provided on the inner and/or outer surface of the hollow cylinder 32. This layer may have the shape of one or more rings or it may have the shape of, for example, a helix or a combination of one or more rings with a helix. The layer of resistive material may be provided either before securing the hollow cylinder to the triode or afterwards. In the latter case it is ensured that the resistive layer is not exposed to the elevated temperatures occurring during the connection process. It is, for example, possible to make very stable high-ohmic resistive layers by mixing $RuO_2$ or $RuCl_3$ particles with glass enamel and by providing layers thereof on the inner side of the tube neck by means of, for example, a suction technique. As compared with a resistive layer on the outer surface, a resistive layer on the inner surface has the advantage that problems resulting from an undefined charging of the inner wall cannot occur. During firing the glass enamel melts and a high-ohmic conducting glass layer, which is very stable and which does not change during processing of the tube, is obtained on the glass wall. A helical resistive layer may be made, for example, by scratching a helical interruption having the desired pitch by means of a scratching pin in the powder layer on the glass wall prior to firing. These layers have been found to be resistant to the tube processing (fusion of the neck, aquadag firing, glass frit seal, exhausting process) and to the so-called sparking of the tube.

Instead of the flat metal ring 29 at the end of the cylinder 32 a bush provided with a collar and fitting in the hollow cylinder may be used alternatively.

Figure 1:
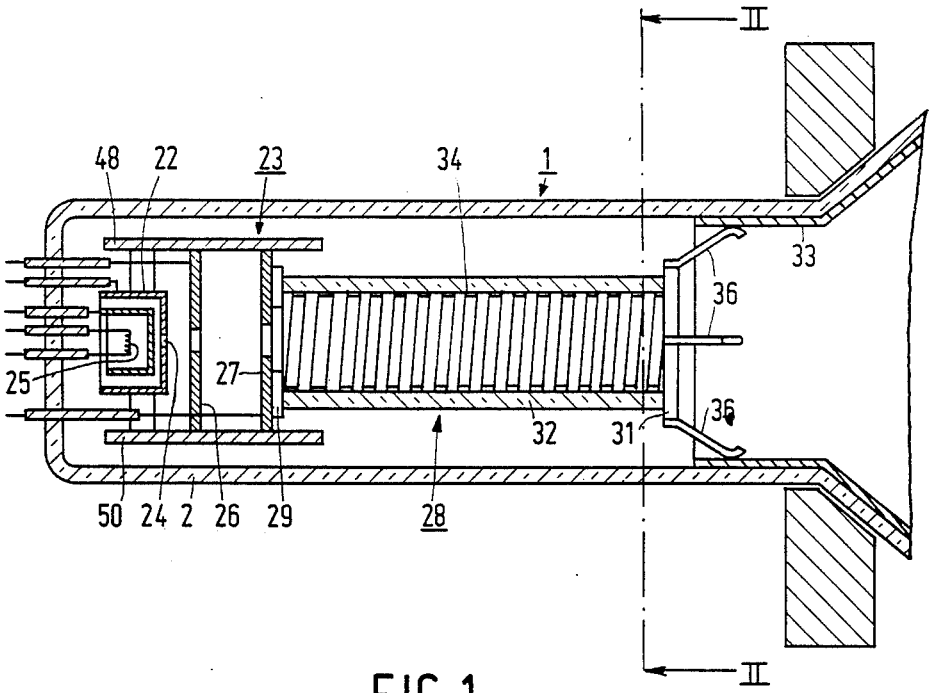
FIG. 1 is a diagrammatic cross-section of a cathode ray tube according to the invention comprising a gun having a focusing structure of the tubular type secured in a special manner.
Figure 2:
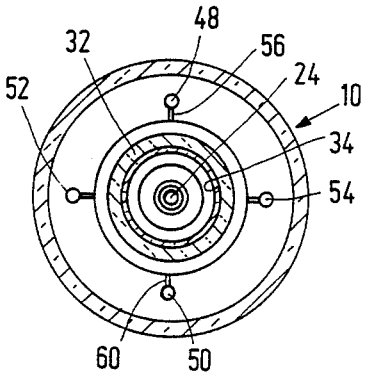
FIG. 2 is an elevational view of a diagrammatic cross-section taken on the line II—II in FIG. 1.

A metal plate may also be arranged at the other end of the hollow cylinder (plate 31 in FIG. 1). Springs 36 for centring the electron gun in the tube neck and possibly also for establishing electrical contact between the end of the resistive layer of the focusing structure and a conducting layer (layer 33 in FIG. 1) which is connected to a high-voltage contact, may be welded to this plate 31.

Figure 4:
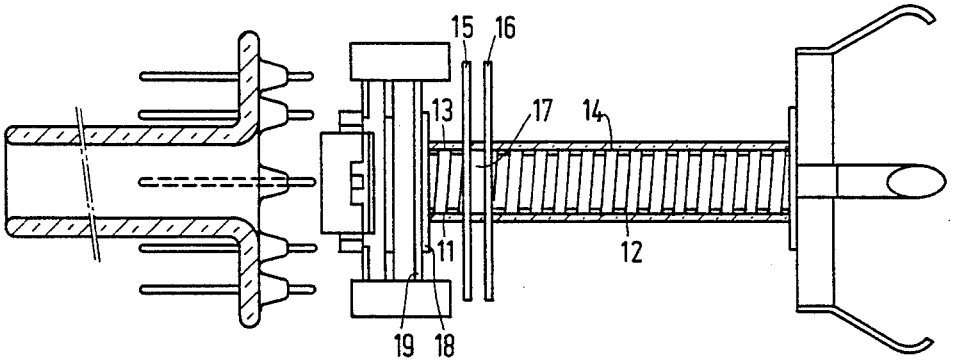
FIG. 4 is a diagrammatic cross-section through an electron gun for a cathode ray tube according to the invention having a prefocusing structure and a focusing structure which are both of the tubular type.

The afore-mentioned focusing structure can only comprise a main lens, or possibly a part of a main lens, or a main lens preceded by a prefocusing lens. In the latter case the structures constituted by the resistive layers may be arranged in one hollow cylinder, whilst lead-throughs must be made in the cylinder wall for providing the electrical connections between the ends. To avoid the provision of lead-throughs, the focusing structure may alternatively comprise two hollow cylinders 11 and 12 which are coupled together, as is shown in FIG. 4, the first cylinder 11 having a resistive layer structure 13 for forming a prefocusing lens and the second cylinder 12 having a resistive layer structure 14 for forming a main lens. The cylinders 11 and 12 are connected together via flat metal rings 15 and 16 secured to their ends. The connection may be established, for example, by means of a glass ceramic spacer 17. The rings 15 and 16 establish electrical contact with the respective resistive layer structures 13 and 14 and may be used for applying voltages.

The advantage of giving the prefocusing lens the shape of a helical lens instead of the shape of (only) metal components, in which case the beam-forming part has four electrodes instead of three, may be that the spherical aberration of the gun is decreased. Moreover, it may change the tolerance sensitivity of the gun. Cylinder 11 is welded via a further metal ring 18 secured to its end to the last electrode 19 of the beam-forming of the electron gun shown in FIG. 4.

Figure 5:
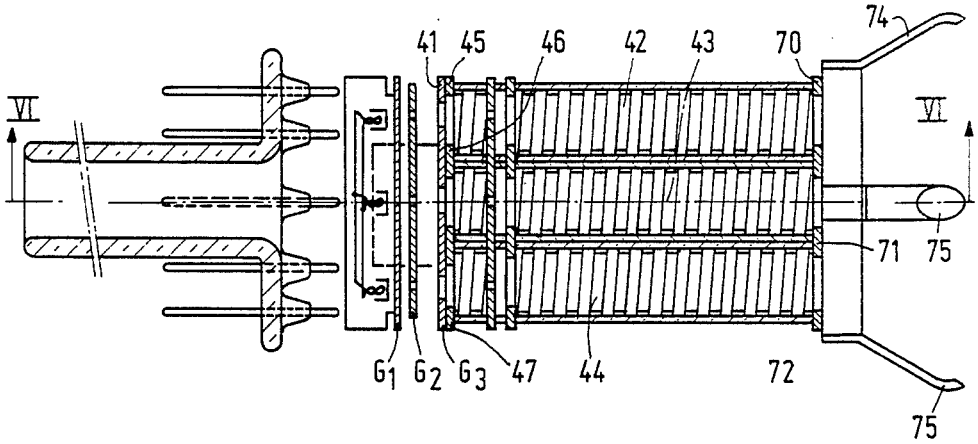
FIG. 5 is a diagrammatic cross-section of a three-beam (color) gun for a cathode ray tube according to the invention.
Figure 6:
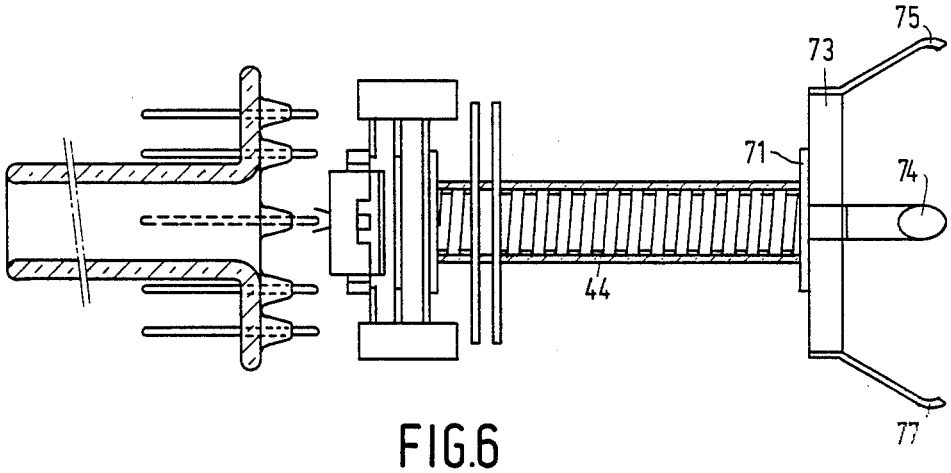
FIG. 6 is an elevational view of a diagrammatic cross-section taken on the line VI—VI in FIG. 5.
Figure 7A:
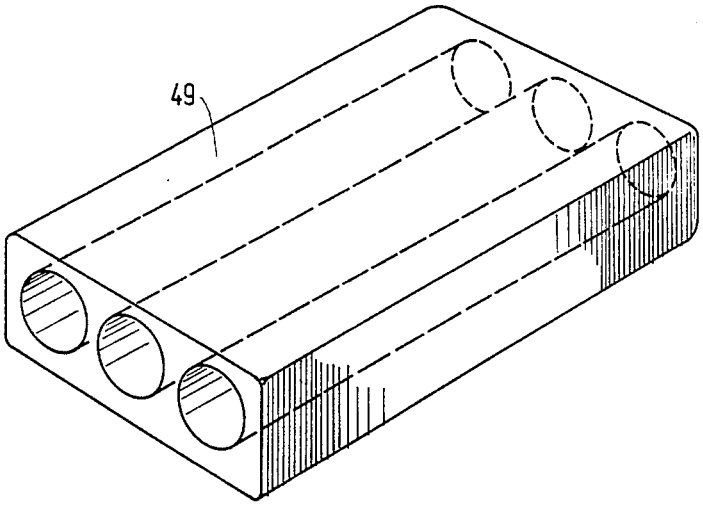
FIGS. 7A and 7B are perspective elevational views of tubes having three ducts for multiple focusing structures.
Figure 7B:
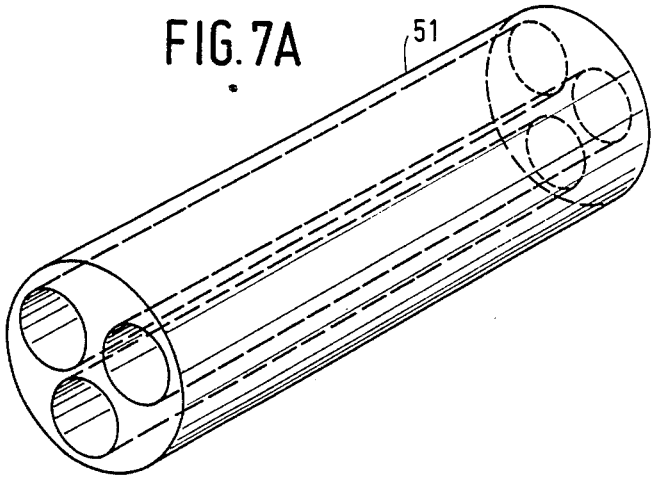
Figure 8:
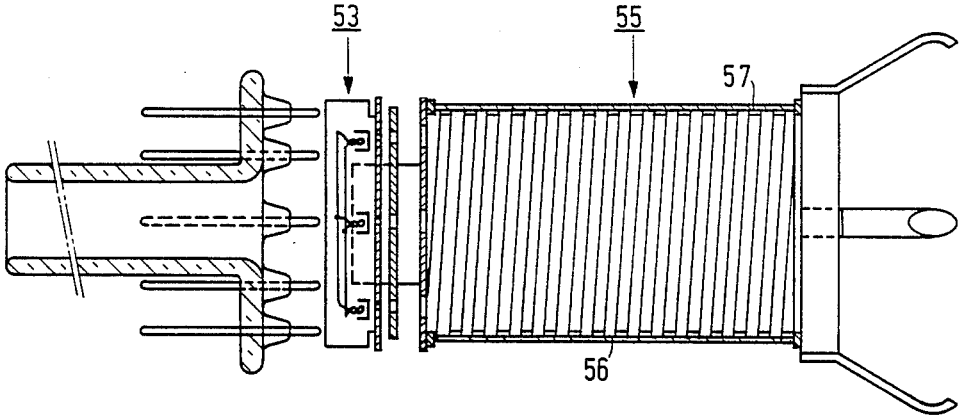
FIG. 8 is a diagrammatic cross-section of a three-beam (color) gun having a common focusing structure of the tubular type.

FIGS. 5 and 6 show an electron gun with a triple (integrated) beam-forming part and three separate focusing structures each comprising a hollow cylinder structure with a resistive layer pattern. Here again the principle of the invention is used advantageously. Three hollow cylinder structures 42, 43, 44 are secured via flat metal rings 45, 46, 47 at their ends to the last (G3) electrode of the beam-forming part, which electrode is constituted by a metal plate 41. Instead of three separate metal rings, one metal plate having three apertures may alternatively be used to secure the hollow cylinder structures to the beam-shaping part. At their opposite ends the cylinders 42, 43, 44 have flat metal rings 70, 71, 72. Ring 71 is fixedly secured (for example, by welding) to a metal plate 73 having centring springs 74, 75, 76, 77. For example, three or six centring springs instead of four may be used alternatively. The resistive layers on the inner surfaces of the hollow cylinders 42, 43, 44 may be connected to electrical voltage sources via the rings 70, 71, 72 in different manners. In the embodiments shown in FIGS. 5 and 6 the cylinder structures are of the type shown in FIG. 4, that is to say, each of them has a first hollow cylinder with a prefocusing lens and a second hollow cylinder with a main lens secured thereto. The invention is, however, not limited thereto. In the embodiments of FIGS. 5 and 6, showing a gun of the in-line type, the cylinder structures are located in one plane, whilst for a gun of the delta type the cylinder structures should be arranged in a triangular configuration. In both cases (glass or ceramic) rods 49, 51 with three internal ducts (FIG. 7A; FIG. 7B) may be used alternatively instead of separate hollow cylinders. It is also possible within the scope of the invention to combine a triple (integrated) beam-forming part 59 with one common focusing structure 55 (FIG. 8) comprising a hollow tube 56 with a resistive layer 57.

Figure 9:
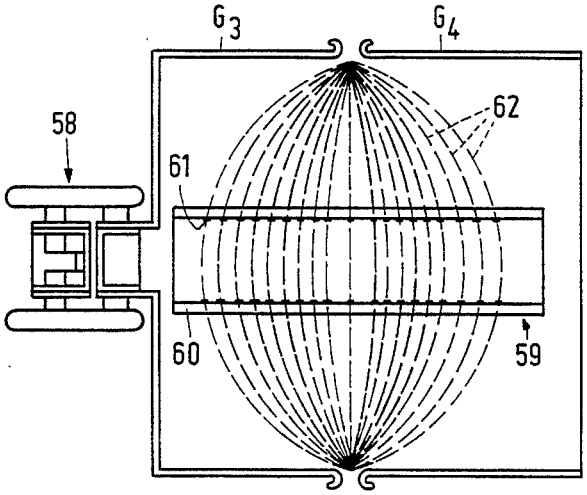
FIG. 9 shows diagrammatically an electron gun in which the equipotential lines produced by the two different types of focusing structures are indicated.

FIG. 9 shows diagrammatically an electron gun with a beam-forming part 58 and a focusing structure 59 comprising a hollow cylinder 60 with a helical resistive layer 61. This resistive layer 61 may be formed in such a manner that equipotential planes 62, which correspond to the equipotential planes of a conventional focusing lens with electrodes $G_3$, $G_4$ (shown in broken lines), are produced when applying a voltage thereacross. This means that the same (small) spherical aberration can be achieved with a gun having a focusing lens constituted by a helical resistive layer of a relatively small diameter as compared with a conventional gun having a much larger diameter. This is notably important in the case of a multi-beam (color) gun which may still have a very small spherical aberration in spite of the fact that there is only a limited space available for the three hollow tubes or ducts with helical structures.

What is claimed is:

1. A cathode ray comprising an envelope containing a luminescent screen and an electron gun for producing an electron beam which is directed to the screen, characterized in that the electron gun comprises:

a. an electron-beam-forming structure including a cathode for emitting electrons and an electrode having a plate-shaped part with an aperture through which the electron beam leaves said structure; and b. an electron-beam-focusing structure including;

(1) a tubular means of an electrical insulating material having an inner surface and an outer surface;

(2) a layer of resistive material disposed on at least one of said surfaces; and (3) a first end part of the tubular means having an aperture for receiving the electron beam and a surface facing the plate-shaped part;

said surface of the first end part being affixed to said plate-shaped part to effect accurate positioning of the electron-beam-focusing structure with respect to the electron-beam-forming structure.

2. A cathode ray tube as in claim 1 where the first end part of the tubular means comprises an apertured metal plate, said plate being directly affixed to said plate-shaped part.

3. A cathode ray tube as in claim 2 where the layer of resistive material is disposed on the inner surface of the tubular means and is in electrical contact with the apertured metal plate.

4. A cathode ray tube as in claim 3 where the tubular means includes a second end part at an opposite end of the tubular means from the first end part, said second end part comprising an apertured metal plate which is in electrical contact with the layer of resistive material.

5. A cathode ray tube as in claim 4 where the envelope includes a neck portion and where the second end part includes springs attached to the respective aperture metal plate for centering the tubular means in said neck portion.

6. A cathode ray tube as in claim 1 where the electron-beam-forming structure is configured to produce a plurality of electron beams for focusing by the electron-beam-focusing structure.

7. A cathode ray tube as in claim 1 or 6 where the tubular means comprises a body having a single tubular hollow.

8. A cathode ray tube as in claim 7 where the tubular means comprises a tube.

9. A cathode ray tube as in claim 6 where the tubular means comprises a body having a plurality of tubular hollows for receiving respective ones of the electron beams.

10. A cathode ray tube as in claim 6 where the tubular means comprises a plurality of tubes for receiving respective ones of the electron beams.

11. A cathode ray tube as in claim 1 where the electron-beam-focusing structure comprises a prefocusing lens portion and a main-focusing lens portion.

12. A cathode ray tube comprising an envelope containing a luminescent screen and an electron gun for producing an electron beam which is directed to the screen, characterized in that the electron gun comprises:

a. an electron-beam-forming structure including a cathode for emitting electrons and an electrode having a plate-shaped part with an aperture through which the electron beam leaves said structure; and b. an electron-beam-focusing structure including a prefocusing lens portion and a main-focusing lens portion;

said prefocusing lens portion comprising:

(1) a first tubular means of an electrical insulating material having an inner surface and an outer surface;

(2) a first layer of resistive material disposed on at least one of said surfaces;

(3) a first end part of the first tubular means having an aperture for receiving the electron beam and a surface facing the plate-shaped part; and (4) a second end part of the first tubular means having an aperture through which the electron beam leaves the prefocusing lens portion;

said main-focusing lens portion comprising:

(5) a second tubular means of an electrical insulating material having an inner surface and an outer surface;

(6) a second layer of resistive material disposed on at least one of said surfaces; and (7) a first end part of the second tubular means having an aperture for receiving the electron beam;

said first end part of the second tubular means being secured to the second end part of the first tubular means to attach the main-focusing-lens portion to the prefocusing lens portion, and said surface of the first end part of the first tubular means being affixed to said plate-shaped part to effect accurate positioning of the electron-beam-focusing structure with respect to the electron-beam-forming structure.

* * * * *